US007950199B2

(12) United States Patent
Newhouse et al.

(10) Patent No.: US 7,950,199 B2
(45) Date of Patent: May 31, 2011

(54) ADJUSTABLE CABINET FILLERS

(75) Inventors: Thomas J. Newhouse, Grand Rapids, MI (US); Troy McDaniel, Greenwood, MS (US)

(73) Assignee: Viking Range Corporation, Greenwood, MI (US)

( * ) Notice: Subject to any disclaimer, the term of this patent is extended or adjusted under 35 U.S.C. 154(b) by 0 days.

(21) Appl. No.: 12/468,342

(22) Filed: May 19, 2009

(65) Prior Publication Data

US 2009/0272044 A1 Nov. 5, 2009

Related U.S. Application Data

(63) Continuation-in-part of application No. 12/122,917, filed on May 19, 2008.

(60) Provisional application No. 60/930,809, filed on May 18, 2007, provisional application No. 61/054,246, filed on May 19, 2008.

(51) Int. Cl.
*E04F 19/04* (2006.01)

(52) U.S. Cl. ..... 52/741.4; 52/717.01; 52/278

(58) Field of Classification Search ..... 52/275, 52/276, 278, 279, 282.1, 287.1, 58, 60, 393, 52/396.04, 717.01, 741.4, 573.1; 312/198, 312/139.1, 109, 111, 245
See application file for complete search history.

(56) References Cited

U.S. PATENT DOCUMENTS

D141,017 S 4/1945 Stanitz
2,661,994 A * 12/1953 Knuth ..... 312/107
2,661,995 A 12/1953 Knuth
3,170,268 A 2/1965 Balzer
3,270,474 A 9/1966 Driggers
3,331,171 A 7/1967 Hallock
3,390,501 A 7/1968 Driggers
3,435,574 A 4/1969 Hallock
3,608,254 A 9/1971 Sklamberg
3,636,668 A * 1/1972 Klingensmith ..... 52/282.3
3,659,390 A 5/1972 Balzer et al.
3,937,133 A * 2/1976 Bertin et al. ..... 454/320
3,950,049 A 4/1976 Drass
3,971,605 A 7/1976 Sasnett
4,123,129 A * 10/1978 Butler ..... 312/265.3
4,189,885 A * 2/1980 Fritz ..... 52/287.1
4,192,113 A * 3/1980 Martin, Jr. ..... 52/282.5
4,326,365 A 4/1982 Svensson
4,439,960 A 4/1984 Jenkins
4,555,885 A 12/1985 Raymond et al.
4,611,449 A 9/1986 Wilson et al.
4,689,930 A * 9/1987 Menchetti ..... 52/277
4,811,529 A 3/1989 Harris et al.
5,357,727 A 10/1994 Duckworth et al.
5,365,713 A 11/1994 Nicholas et al.
5,367,850 A * 11/1994 Nicholas ..... 52/516
(Continued)

*Primary Examiner* — Khoi Tran
*Assistant Examiner* — Jason Holloway
(74) *Attorney, Agent, or Firm* — Womble Carlyle Sandridge & Rice, PLLC

(57) ABSTRACT

A filler assembly for spanning, filling, and concealing a gap between an installed metal cabinet and an adjacent wall, or adjacent cabinet is disclosed. The assembly includes a bracket, a backing strip and a filler strip and the filler strip is formed with a projecting tongue. The bracket includes a narrow channel sized to receive the tongue of the filler strip in a sliding relationship. The tongue of the filler strip can slide into the channel to different depths so that the tongue and bracket span and fill the gap and the position of the backing strip can be adjusted by an adjustment feature.

7 Claims, 7 Drawing Sheets

U.S. PATENT DOCUMENTS 5,502,937 A 4/1996 Wilson
5,551,201 A 9/1996 Anderson
5,901,513 A 5/1999 Mollenkopf et al.
5,951,127 A 9/1999 Smith
6,238,028 B1 * 5/2001 Benner et al. ..... 312/265.3
6,256,953 B1 7/2001 Vulin
6,526,707 B2 3/2003 Tucker
7,207,636 B2 4/2007 Livingston et al.
7,240,905 B1 7/2007 Stahl
2002/0108327 A1 8/2002 Shaw
2005/0073224 A1 * 4/2005 Livingston et al. ..... 312/265.6
2008/0042531 A1 2/2008 Livingston et al.
2008/0172961 A1 7/2008 Wu
2009/0056252 A1 * 3/2009 Taylor et al. ..... 52/287.1

* cited by examiner

ADJUSTABLE CABINET FILLERS

CROSS REFERENCE TO RELATED APPLICATIONS

This application is a Continuation-in-Part of application Ser. No. 12/122,917, filed May 19, 2008, which claims the benefit of U.S. provisional patent application No. 60/930,809, filed May 18, 2007. This application also claims the benefit of U.S. provisional patent application No. 61/054,246, filed May 19, 2008.

TECHNICAL FIELD

The invention relates generally to cabinets and more specifically to filling gaps between installed cabinets and an adjacent structure such as a wall or another cabinet.

BACKGROUND

Installing a cabinet adjacent a wall often requires a spacer or a trim strip to fill a gap between the wall and cabinet. The gap may arise, for example, because the edge of the cabinet is not parallel with the wall, because the wall or cabinet edge is not plumb, or simply because the cabinet is sized to be slightly shy of the wall. In the past, it was necessary to fabricate custom filler or trim strips to contour to the wall, span the gap between the wall and cabinet, and thereby fill or cover the gap. Fabricating such filler and/or trim strips is time consuming and can require substantial skill to scribe and conform the filler strip to the contours of an uneven wall. Accordingly, a need existed for a cabinet filler strip that self-adjusts to virtually any gap size and configuration and requires little skill to install.

SUMMARY

Briefly described, a cabinet filler assembly is disclosed for spanning, filling, and concealing a gap between an installed metal cabinet and an adjacent wall, or adjacent cabinet. More generally, the filler assembly spans and fills a gap between a first structure and an adjacent second structure. In one aspect, the assembly includes a bracket and a filler strip, with the filler strip formed with a projecting tongue. The bracket includes a narrow channel sized to receive the tongue of the filler strip in an adjustably sliding relationship. In other words, the tongue of the filler strip can slide into the channel to different depths. A backing strip can be arranged and spaced from the bracket such that the two structures establish the narrow channel. When a first structure (e.g. a cabinet) is installed adjacent a second structure (e.g. a wall) with the filler assembly in between, the tongue of the filler strip is disposed in the channel of the bracket to a depth determined by the width of the gap between the structures. The position of the backing strip relative to the bracket is adjusted by an adjustment feature, which also attaches the backing strip to a flange. The bracket and filler strip thereby fill and conceal the gap between the two structures and self adjusts to varying gap dimensions and irregularities.

In another aspect, a filler assembly for filling a gap between a first structure and an adjacent second structure is disclosed with the assembly including a bracket arranged on the first structure and a filler strip having a projecting tongue. The bracket includes a channel sized to receive the tongue of the filler strip in a sliding relationship. When the first structure is installed adjacent to the second structure, the tongue is disposed in the channel and the bracket and filler strip are positioned to fill a gap between the two structures.

In yet a further aspect, a method of filling a gap between a cabinet and a structure is disclosed. Briefly, the method includes attaching a filler strip to the structure, attaching a bracket to the cabinet, and installing the cabinet adjacent the structure such that a projecting tongue of the filler strip is slidably received in a channel on the bracket with the tongue and the bracket filling the gap between the cabinet and the structure.

BRIEF DESCRIPTION OF THE DRAWINGS

According to common practice, the various features of the drawings discussed below are not necessarily drawn to scale. Dimensions of various features and elements in the drawings may be expanded or reduced to illustrate more clearly the embodiments of the invention.

DETAILED DESCRIPTION

Figure 1:
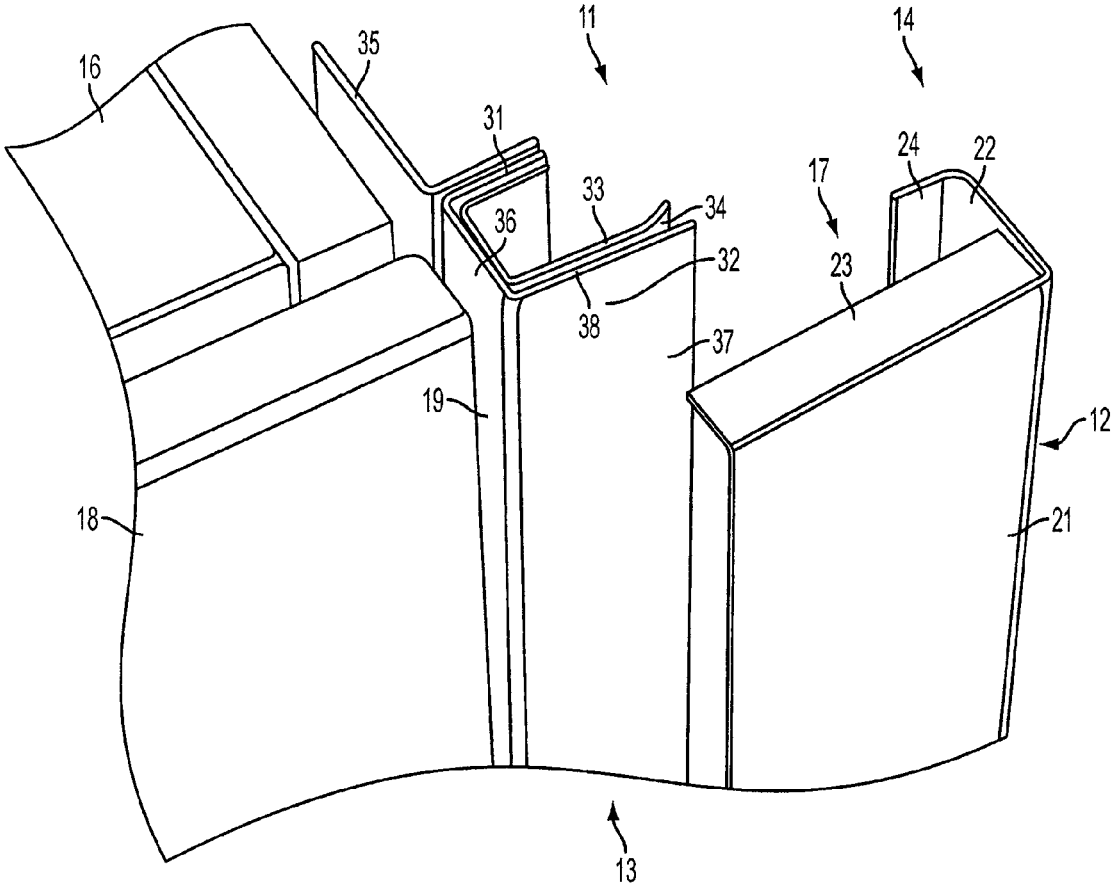
FIG. 1 is a perspective view of a cabinet filler assembly that embodies principles of the invention.

Referring now in more detail to the drawings, wherein like numerals refer to like parts throughout the several views, FIG. 1 illustrates a cabinet filler assembly 11 that embodies principles of the invention in one preferred form. The filler assembly 11 includes a bracket 13 and a filler strip 12 that, when assembled as detailed below, span and conceal a gap 17 between a cabinet 16 and an adjacent structure such as a wall 14. The bracket 13 may be attached to an edge of the cabinet 16 and the filler strip 12 may be attached to the adjacent wall 14, or some other structure, or, in some applications, may not be attached at all. Optionally, the ease of assembly can be further enhanced for example, where the bracket 13 can be attached to the wall 14 and the filler strip 12 can be attached to the edge of the cabinet 16.

With continuing reference to FIG. 1, the filler strip 12 has a base 22 attached to the wall 14 with screws or other appropriate fasteners (not visible) which include, but are not limited to, bolts, nails, rivets, pins, and the like. Additionally, the filler strip 12 may be welded, glued, or soldered to the wall 14. The base 22 has sufficient width and thickness to support the filler strip 12 against the wall 14. The filler strip 12 further includes an elongated and relatively flat tongue 21 projecting away from the base 22 at approximately a right angle with respect to the wall 14 in the embodiment of FIG. 1. However, the tongue 21 could project away from the wall 14 at any appropriate angle other than a right angle if, for example, the cabinet 16 is to meet the wall 14 at other than a right angle. The tongue 21 generally extends the full height or length of the filler strip 12. However, there may be some configurations that require the tongue to extend less that the entire height of the filler strip 12. The filler strip tongue 21 generally extends a sufficient distance from the wall 14 to engage with the bracket 13 as detailed below to fill the gap 17. An in-turned top 23 further conceals the gap 17 between the wall 14 and the cabinet 16. The top 23 can be integral with the filler strip 12 or attached to the filler strip 12 as the filler strip 12 is fabricated.

The filler strip 12 also includes a rear flange 24. The rear flange 24 is adjacent the filler strip base 22 and in addition to making the filler strip 12 more rigid, provides minimal guidance for the bracket 13 during assembly.

The bracket 13 illustrated in FIG. 1 includes a base 31 that provides a location of attachment of the bracket 13 to the cabinet 16 and has a sufficient width to support the bracket securely to the cabinet 16. Alternatively, a bracket side 36 can be the surface of attachment for the bracket 13 to the cabinet 16, or as another alternative, the bracket 13 can be attached to a flange 35 secured to the base 31, with the flange 35 being attached directly to the cabinet 16. The bracket 13 can be attached to the cabinet 16 with screws or other appropriate fasteners such as, but not limited to, bolts, nails, rivets, pins, and the like. Additionally, the bracket 13 can be welded, glued, or soldered to the cabinet 16. When attached to the cabinet edge, the bracket 13 is spaced appropriately from cabinet 16, or a cabinet door or drawer 18, to provide a narrow gap 19 to accommodate operation of the door or drawer 18. Use of a flange 35 to which the bracket is attached allows for easier location of the bracket 13 relative the front of the cabinet 16. Regardless of how the bracket 13 is attached, it includes a generally flat bracket face 37 that projects away from the cabinet face as shown in FIG. 1.

A backing strip 34 is mounted to the bracket 13 and has a leg behind and slightly spaced from the bracket face 37 to define a channel 33 extending away from the bracket side 36 and the cabinet 16. The backing strip 34 and/or the channel 33 may be formed as an integral component with the bracket 13, such as being cast or molded into the bracket 13 during fabrication, and in any event, is sized to receive the filler strip tongue 21 in sliding relationship. The bracket face 37 extends a sufficient distance from the bracket side 36 and the cabinet 16 to provide proper engagement with the filler strip tongue 21 when the cabinet 16 is installed adjacent the wall 14. The bracket face 37 is approximately flush with the closed cabinet door or drawer 18 in FIG. 1 to provide an aesthetically pleasing appearance.

The filler strip 12 and bracket 13 can be fabricated from any suitable material such as stainless steel, sheet metal, or sheet aluminum formed as required to provide the proper shapes and produce structures that are easy and efficient to manufacture. A suitable metal is a metal that provides proper strength for the environment where installed and yet is sufficiently malleable to flex as required. Though not required, the filler strip 12 and bracket 13 can be cast or produced from any suitable manufacturing technique. The filler strip 12 and bracket 13 can accept a variety of paints or surface finishes for aesthetic compatibility with the finished cabinet surface. The components also can be constructed of molded and/or extruded plastic, if desired.

Figure 2:
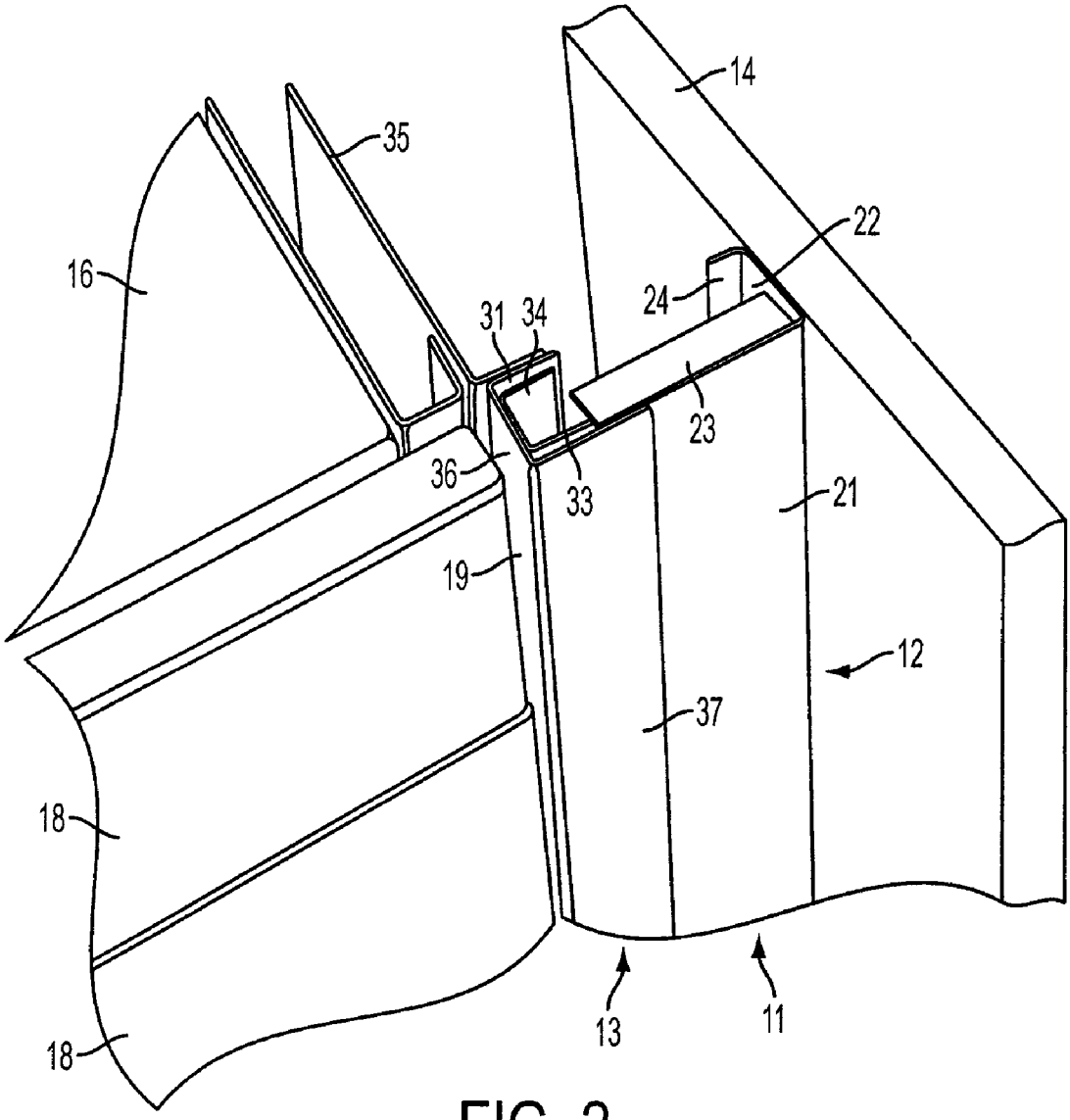
FIG. 2 is a perspective view of the cabinet filler assembly of FIG. 1 in an installed configuration filling a gap between a cabinet and a wall.

Referring now to FIG. 2, the filler assembly 11 is illustrated as it appears when the cabinet 16 is installed adjacent the wall 14 in an assembled configuration. The filler strip tongue 21 is shown received in sliding relationship within the channel 31 such that the tongue 21 and face 37 of the bracket 13 span and fill the gap 17 (FIG. 1) between the wall 14 and cabinet 16. A sufficient portion of the filler strip tongue 21 extends into the channel 33 to create an overlap between the filler strip tongue 21 and the bracket face 37, the two together spanning the gap 17. Ideally, the filler strip top 23 is approximately flush with the top of the cabinet 16 or top of the cabinet door or drawer 18. The channel 33 can be narrower than the thickness of the filler strip tongue 21 to produce an interference fit, which could be beneficial to reduce sliding between the channel 33 and the tongue 21 and inhibit rattling between contacting metal surfaces. As illustrated in FIG. 2, the filler strip tongue 21 projects from the wall 14 at a right angle and extends substantially the entire height of the cabinet 16 filling the entire gap 17.

With continued reference to FIG. 2, one possible method of installing the cabinet to take advantage of the filler assembly 11 is as follows. The filler strip 12 is securely attached to the wall 14 or adjacent structure so that the filler strip tongue projects away from the wall 14 or adjacent structure. The bracket 13 is attached to a corner or forward edge of the cabinet 16 with the channel 33 facing away from the cabinet 16. The cabinet 16 is then positioned proximate and adjacent to the wall 14 or adjacent structure with the channel 33 of the bracket 13 aligned with the tongue 21. The cabinet 16 is then moved toward the wall 14 or adjacent structure until the tongue 21 slides into the channel 33, as illustrated in FIG. 2, whereupon the cabinet 16 can be secured in place. With the tongue 21 received in sliding relationship within the channel 33, the gap 17 between the cabinet 16 and wall 14 or adjacent structure is filled in an aesthetically pleasing way.

Figure 3:
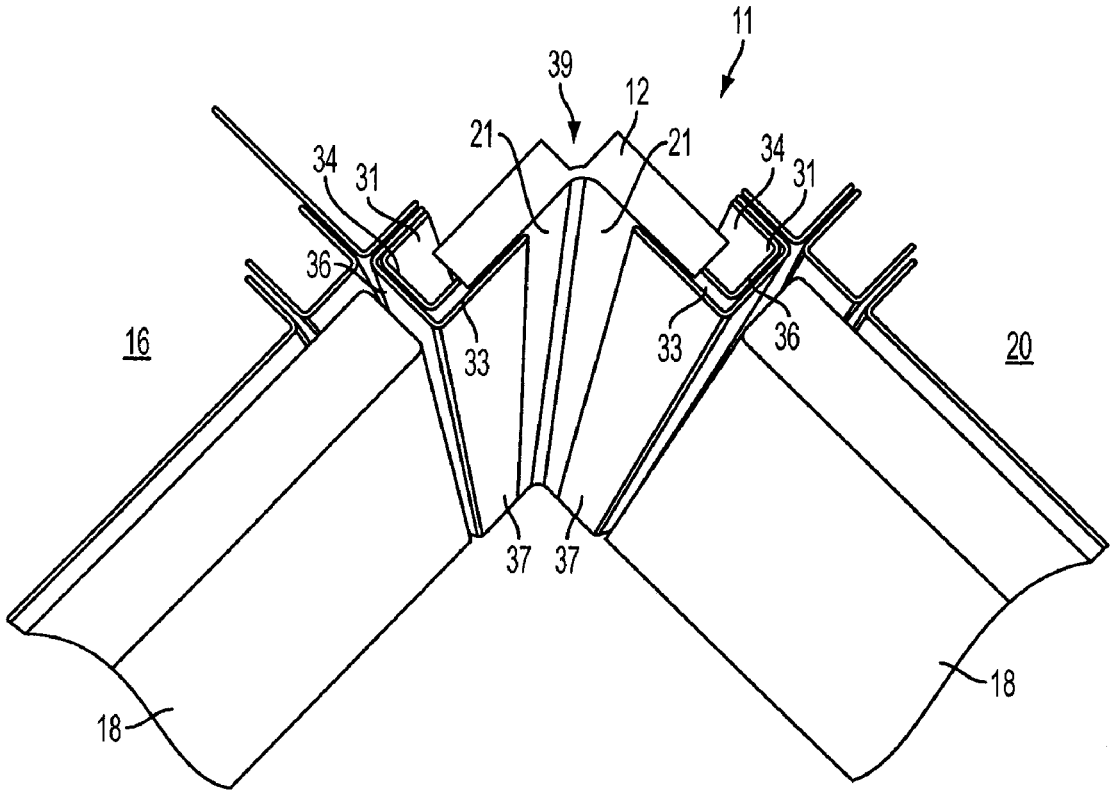
FIG. 3 is a perspective view of a further embodiment of a cabinet filler.

FIG. 3 illustrates an alternate embodiment of the invention for filling a corner gap 39 between two cabinets 16, 20. A filler strip 12 is shown having two filler strip tongues 21, each tongue extending toward an adjacent cabinet 16, 20 and filling a corner gap 39 between the two cabinets. The filler strip 12 does not require attachment to a wall 14, or adjacent structure but rather floats in the corner gap 39. The corner gap 39 is illustrated as representing approximately a right angle between the two cabinets, but it is not a requirement that the corner be a right angle. The angle may be any standard or non-standard angle that would be encountered during cabinet installation. As shown in FIG. 3, each cabinet 16, 20 has a bracket 13 attached along the cabinet edge with each bracket 13 having a channel 33, as detailed relative to FIGS. 1 and 2, extending away from its cabinet 16, 20. Filler strip tongues 21 are received in sliding relationship within the channels 33 to span, extend around, and fill the corner gap 39. A possible method of installing the cabinets 16, 20 to take advantage of the filler strip assembly 11 is as follows. Initially, one of the cabinets 16 is placed in approximately its final location with the channel 33 of its bracket 13 facing away from the cabinet 16. A first tongue 21 of the filler strip 12 is aligned with the channel 33 and received therein in sliding relationship. The channel 33 on the bracket 13 of adjacent cabinet 20 is positioned proximate to the second tongue 21 of the filler strip. Adjusting both the filler strip 12 and adjacent cabinet 20, the second tongue 21, which is slidably received by channel 33. With both tongues 21 disposed in sliding relationship within their respective channels 33, the cabinets 16, 20 are secured in their final positions. The term "final position" refers to the installed position.

Figure 3A:
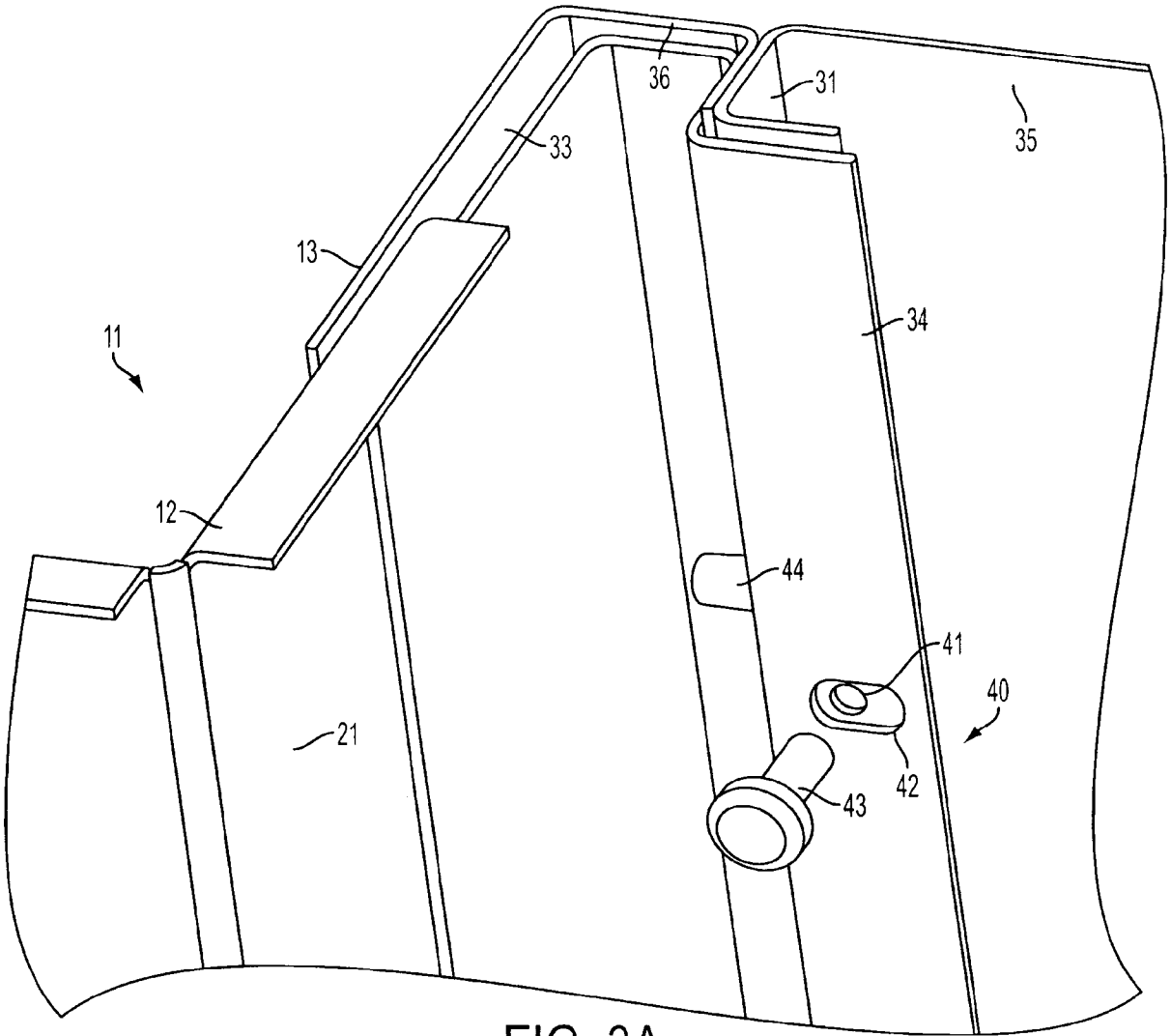
FIG. 3A is a perspective view of an adjustment feature of the cabinet filler.

FIG. 3A illustrates an adjustment feature 40 of the filler assembly 11. A backing strip 34 is mounted to a flange 35 by an adjusting screw 43. In this embodiment, the backing strip 34 forms a portion of the channel 33, which slidably receives a filler strip tongue 21. The adjusting screw 43 rigidly connects the backing strip 34 and flange 35, and extends through an elongated hole 42 in the backing strip 34 and a hole 41 in the flange 35. The adjusting screw 43 can be threaded directly into the hole 42 and tightened sufficiently to permit sliding motion between the backing strip 34 and flange 35. When the backing strip 34 is located in final position such that a filler strip 12 is properly placed in final position, the adjusting screw can be tightened and the backing strip 34 prevented from further sliding. The adjustment feature 40 as illustrated is an adjusting screw 43, however other suitable adjustment features 40 can be used such as pins, bolts, rivets, and the like provided the adjustment feature 40 can secure the backing strip 34 to the flange 35 and permit relative movement between the two. Also illustrated is screw 44, which attaches a bracket 13 to a base 31, or mating plate 31. The screw 44 extends through the mating plate 31 and backing strip 34, connecting to the bracket 13 and securing the bracket 13 to the mating plate 31.

The filler assembly 11 is intended to span the gap 17 between a cabinet 16 and a structure, such as a wall 14 or cabinets meeting at a corner, between cabinets installed adjacent one another along a wall, or between acute angles with respect to each other, such as at a wall corner. The filler strip assembly 11 can be sized to span any size gap, but preferably to span linear gaps in the range of one to four inches.

Figure 4A:
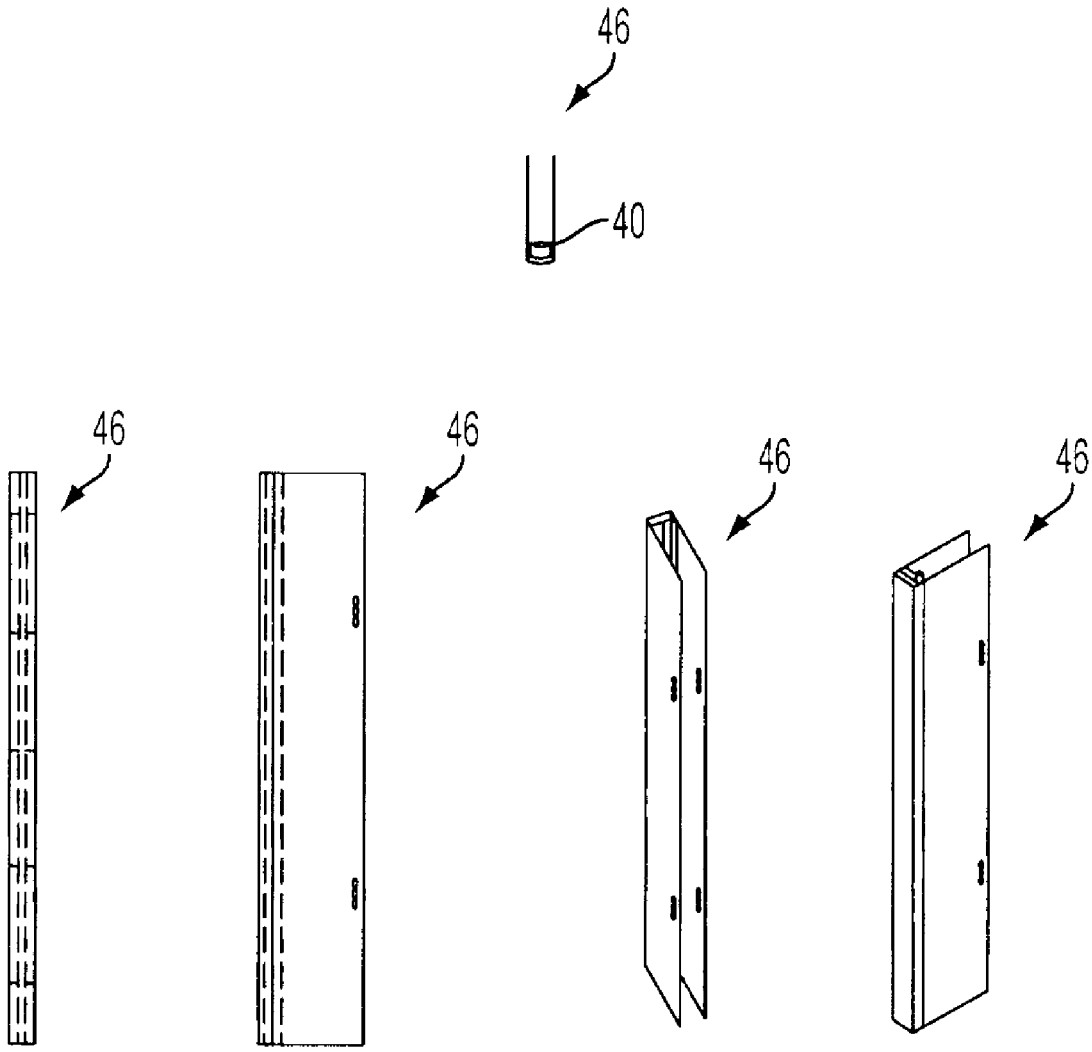
FIGS. 4A-4C show alternate filler configurations.
Figure 4B:
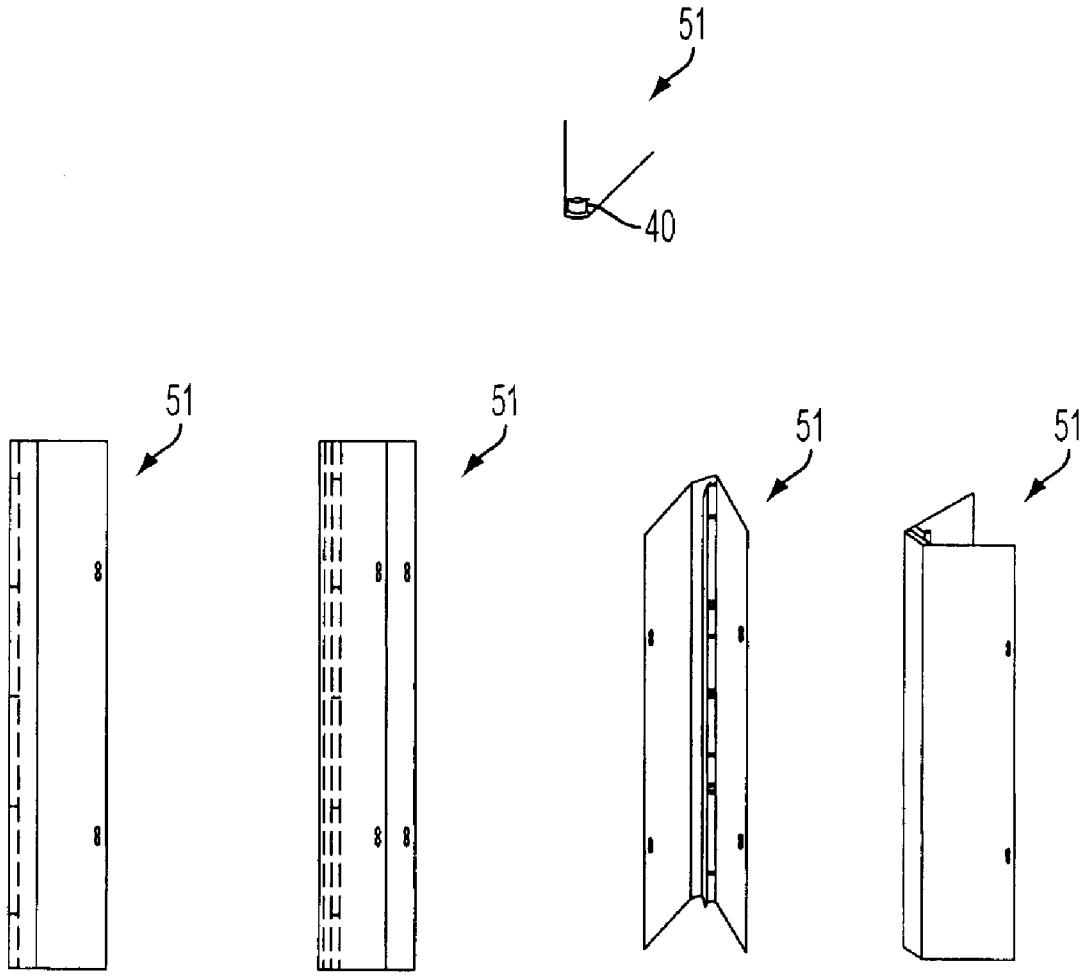
Figure 4C:
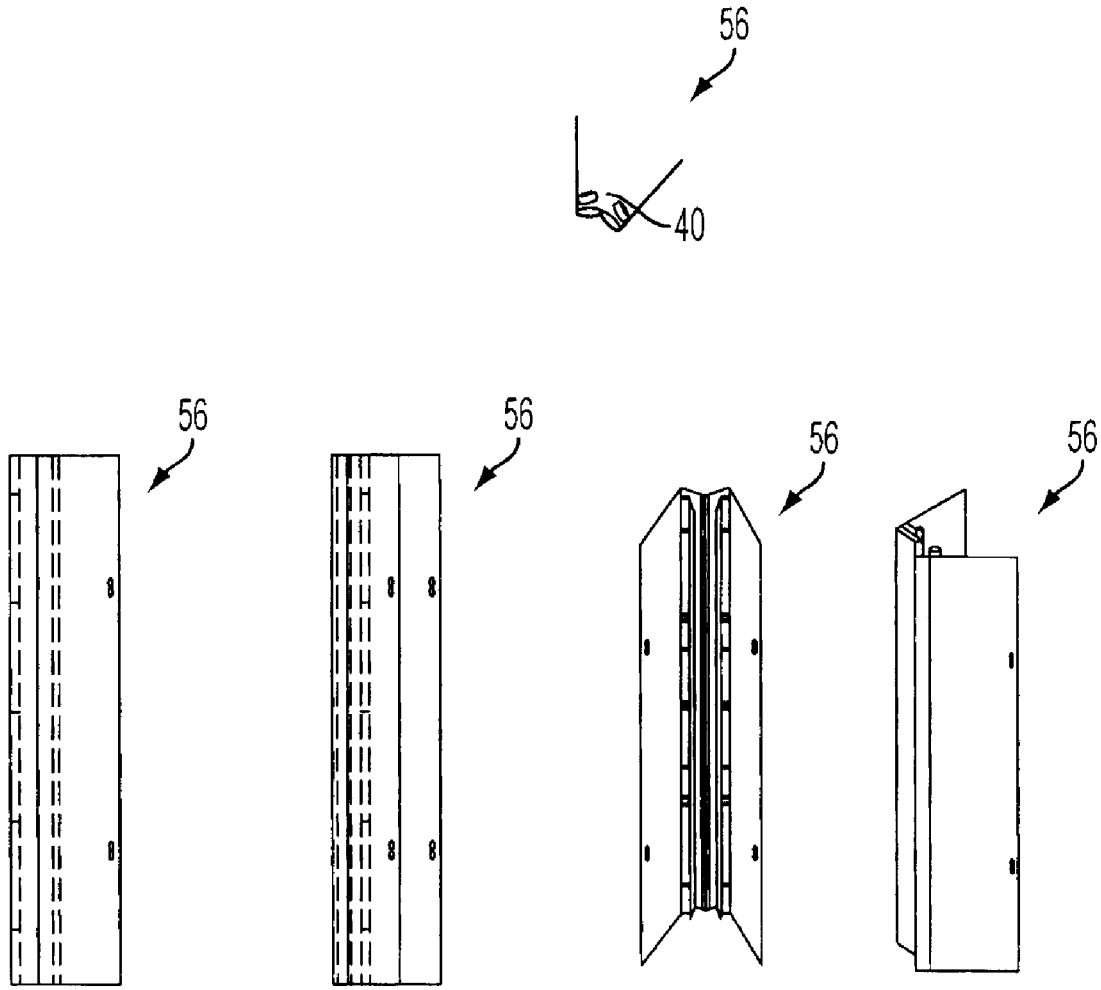

FIGS. 4A-4C show alternate filler configurations that include the adjustment feature as illustrated in FIG. 3A. FIG. 4A illustrates several views of an adjustable filler 46 to span a gap between adjacent cabinets, and having an adjustment feature 40. FIG. 4B illustrates several views of an adjustable filler 51 to span a gap between two cabinets installed at a wall having a 135° zero clearance corner. A 135° zero clearance corner is generally understood to be a corner having little or no space between adjacent cabinets and the adjustable filler being approximately "V" shaped and arranged between the cabinets. FIG. 4C illustrates several views of an adjustable filler 56 to span a gap between two cabinets installed at a wall having a 135° corner.

The foregoing description of the invention illustrates and describes the present invention. Additionally, the disclosure shows and describes only selected preferred embodiments of the invention, but it is to be understood that the invention is capable of use in various other combinations, modifications, and environments and is capable of changes or modifications within the scope of the inventive concept as expressed and claimed herein.

We claim:

1. A method of filling a gap between a cabinet and a structure, comprising:

attaching a generally J-shaped filler strip to the structure;

attaching a generally J-shaped first bracket to the cabinet, wherein a generally J-shaped first backing strip is mounted within the first bracket and having a leg spaced from a bracket face of the first bracket to define a first channel;

installing the cabinet adjacent the structure such that a projecting first tongue of the filler strip is slidably received and slidably adjustable in the first channel on the first bracket, the first tongue and the first bracket filling the gap between the cabinet and the structure; and adjusting a location of a first backing strip relative to the first bracket and tightening an adjusting screw to secure the first backing strip to a flange in a final position.

2. The method of claim 1, wherein the sliding relationship between the first tongue of the filler strip and the first channel is an interference fit.

3. The method of claim 1, wherein the first bracket and the filler strip are fabricated from metal.

4. The method of claim 1, wherein the structure is a wall.

5. The method of claim 1, wherein a second bracket with a second channel is attached to the structure.

6. The method of claim 1, wherein the first channel is sized to receive up to two inches of the tongue.

7. The method of claim 5, further comprising the steps of:

installing the cabinet adjacent the structure such that a projecting second tongue of the filler strip is slidably received in the second channel on the second bracket wherein the first tongue, the second tongue, the first bracket and the second bracket fill the gap between the cabinet and the structure; and adjusting a location of a second backing strip relative to the second bracket and tightening an adjusting screw to secure the second backing strip to a flange in a final position.

* * * * *